United States Patent [19]

McDonald

[11] 4,262,588

[45] Apr. 21, 1981

[54] SCISSOR PRESS

[76] Inventor: William D. McDonald, Rte. 1, Box 322C, Monroe, Oreg. 97456

[21] Appl. No.: 98,747

[22] Filed: Nov. 30, 1979

[51] Int. Cl.[3] ..... B30B 1/08; B30B 15/06

[52] U.S. Cl. ..... 100/234; 72/409; 100/DIG. 13; 100/257; 100/271; 100/295; 227/152

[58] Field of Search ..... 100/233, 234, 257, 295, 100/271, 243, DIG. 13; 227/152; 72/409, 410; 81/301

[56] References Cited

U.S. PATENT DOCUMENTS

| | | | |
|---|---|---|---|
| 2,641,942 | 6/1953 | Mueller | 100/233 X |
| 2,723,574 | 11/1955 | Mueller | 100/233 X |
| 3,577,882 | 5/1971 | Lombard | 100/271 X |
| 3,842,651 | 10/1974 | Shaffer | 100/271 X |

*Primary Examiner*—Billy J. Wilhite
*Attorney, Agent, or Firm*—D. Paul Weaver

[57] ABSTRACT

A press for applying nailing plates across joints of wooden trusses and for other like usage is disclosed. A suspension harness for the press is adapted to be carried by an overhead universally movable support. The lower jaw member of the press is rockably mounted on the suspension harness with adjustment means provided to level the work-engaging jaw plates. An operator-controllable power cylinder is connected between rear arm extensions of the press jaws. The work-engaging jaw plate of the upper jaw is rockable on a transverse axis relative to adjustable plate stops. The lower jaw work-engaging plate is finely adjustable to enable the press to apply nailing plates with even pressure and with the proper degree of penetration into the work pieces and to accommodate variations in thickness of work pieces. Spring loaded guards on the lower jaw working-engaging plate prevent accidental displacement of nailing plates prior to application. Manipulating handles on the suspension harness and power cylinder enable guiding of the press by the operator in all directions.

10 Claims, 6 Drawing Figures

FIG 3
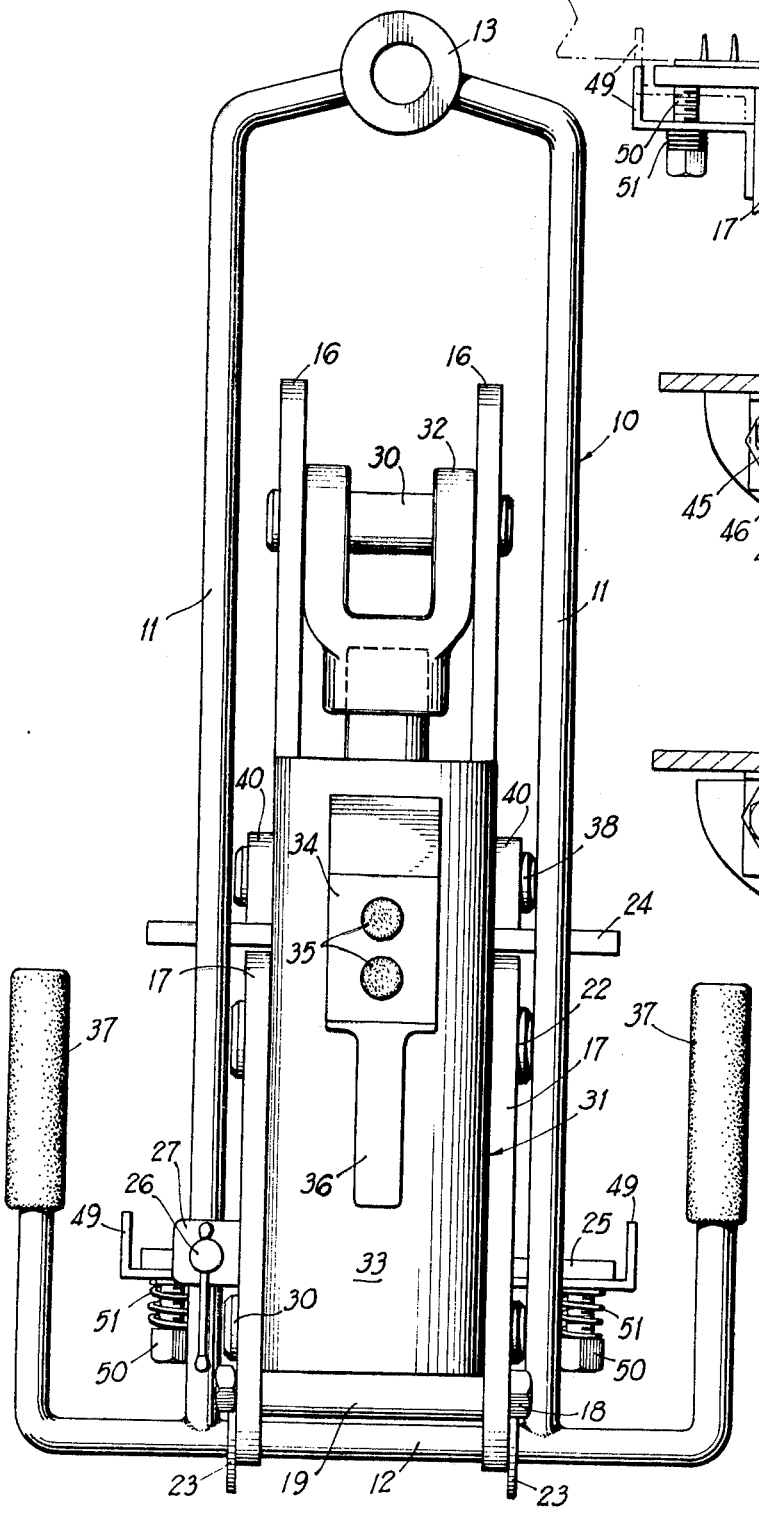
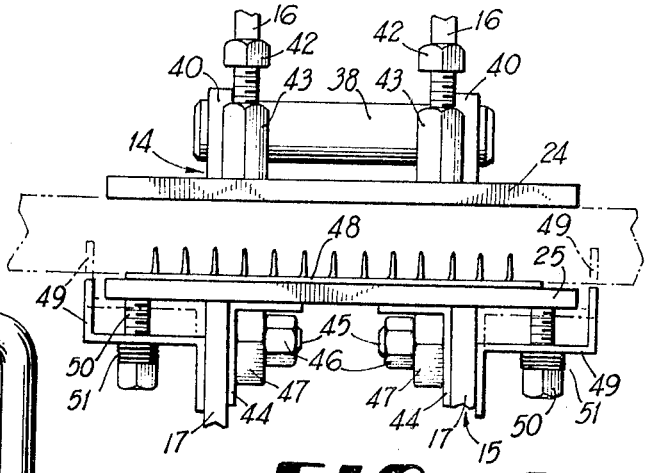
FIG 4
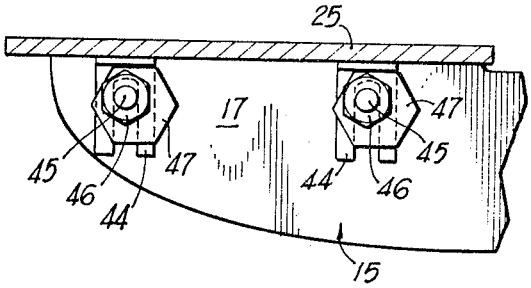
FIG 5
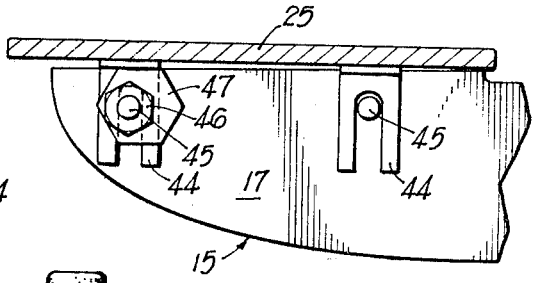
FIG 6

SCISSOR PRESS

BACKGROUND OF THE INVENTION

Power presses for applying nailing plates in bridging relationship to truss lumber joints and the like are well known in the prior art. Commonly, such presses include a rigid non-adjustable C-frame with a linear actuator for a work-engaging press plate attached to one rigid jaw of the C-frame in opposed relationship to a second rigid jaw. Such prior art C-frame presses are somewhat limited in mobility and particularly are limited in their ability to compensate for variations in lumber thickness and other irregularities. Furthermore, the prior art C-frame presses are somewhat awkward to manipulate manually and no means is provided to level the jaw plates of the press in relation to carrying or suspension structure.

One example of a prior art press on which the present invention is an improvement is the press manufactured and sold by The Panel Clip Co., P.O. Box 423, Farmington, Michigan 48024, under the Registered Trademark KLINCHER.

Other prior art presses and like devices are known having jaw members which are swingable in relation to each other including forging presses and riveting machines. Such devices are shown in prior U.S. Pat. Nos. 2,641,942; 2,723,574 and 3,577,882. Because of the relationship of their operating parts, their sizes, and their lack of portability, the devices shown in the above patents are not at all suited to the purposes of the present invention and are simply made of record herein in order to disclose known prior art.

Other features and advantages of the invention over the known prior art contributing to the convenience and efficiency of the power scissor press forming the subject matter of this invention will be made apparent during the course of the following description.

BRIEF DESCRIPTION OF THE DRAWINGS

FIG. 3 is a rear end elevational view of the press.

FIG. 4 is a fragmentary front elevational view showing particularly the adjustable work-engaging jaw plates of the press and associated elements.

FIGS. 5 and 6 are fragmentary side elevational views, partly in cross section, showing the lower jaw plate fine adjusting means.

DETAILED DESCRIPTION

Figure 1:
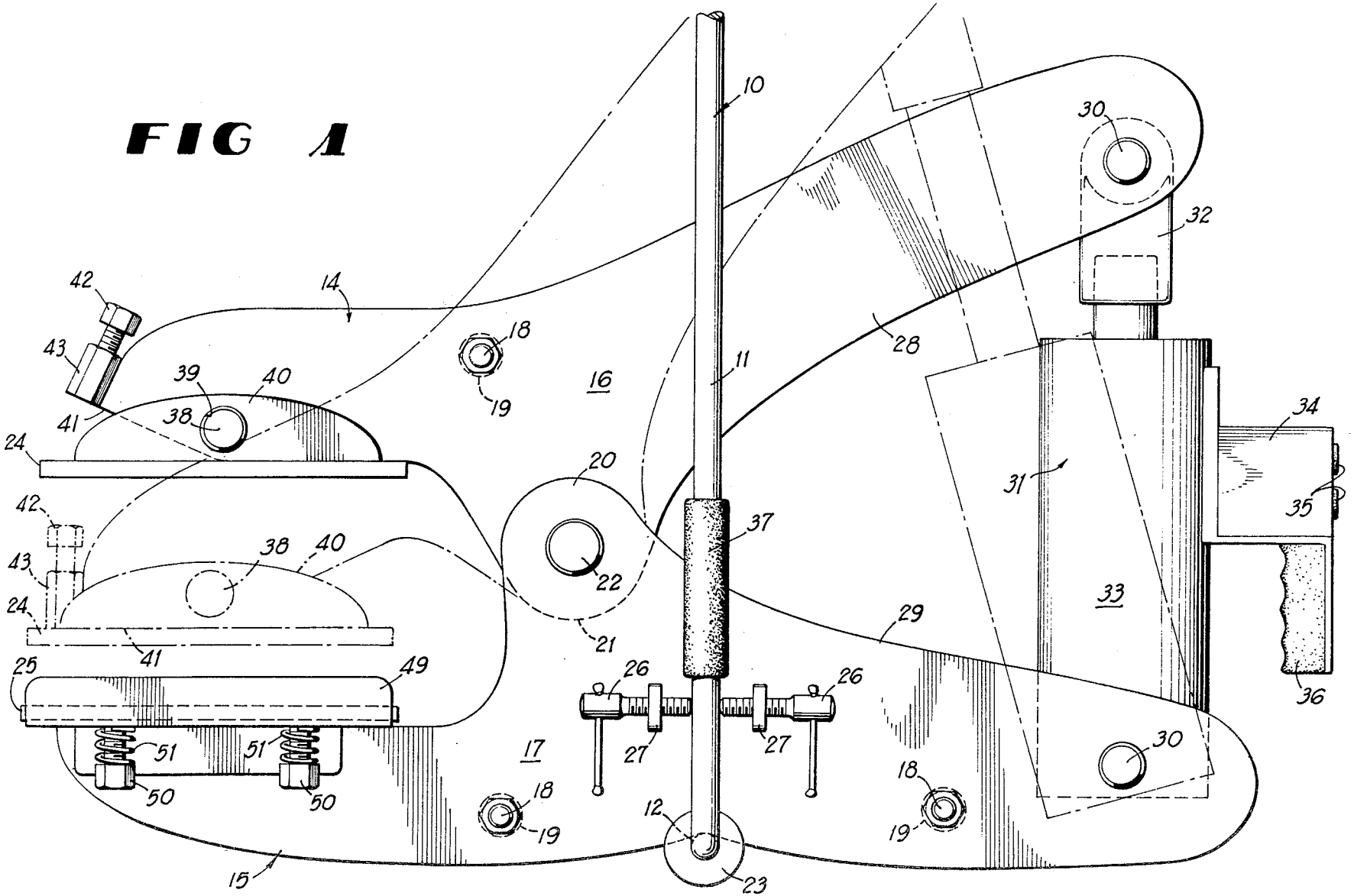
FIG. 1 is a side elevation of the scissor press according to the invention.
Figure 2:
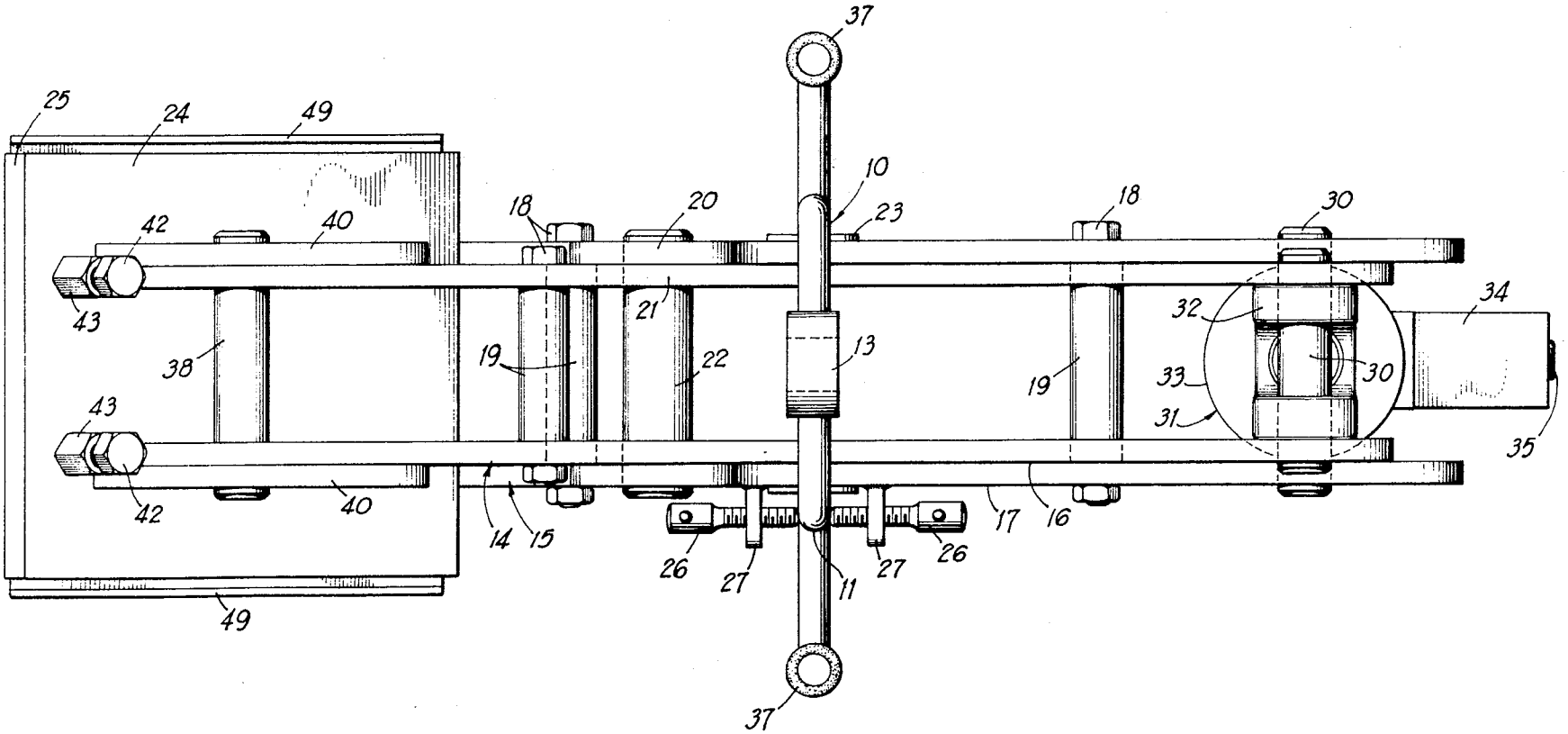
FIG. 2 is a plan view of the press.

Referring to the drawings in detail wherein like numerals designate like parts, the numeral 10 designates a rigid vertically elongated suspension frame or harness including spaced parallel sides 11, a lower end transverse bar 12, and a top end suspension eye 13. In use, an overhead universally movable support boom for the press, not shown in the drawings, includes a suspension cable having a snap hook which securely engages the eye 13. Other forms of mobile overhead support means for the press can be utilized.

The scissor press comprises upper and lower jaws 14 and 15 each consisting of a pair of spaced parallel side plates 16 and 17 secured in spaced relationship by transverse bolts 18 surrounded by spacer sleeves 19 between the respective side plates 16 and 17. The press jaws 14 and 15 include interfitting central lugs 20 and 21, pivotally interconnected by a sturdy transverse axis pivot pin 22.

Near its longitudinal center, the lower jaw 15 has a pair of swivel discs 23 welded to its side plates 17 and the lower bar member 12 of suspension harness 10 engages through aligned apertures in the two discs 23 so as to render the press jaws rockable on the transverse axis of the bar member 12 of the harness. To restrain such rocking action and to enable rather precise leveling of the work-engaging jaw plates 24 and 25, to be further described, adjusting thumb screws 26 are provided at one side of the lower jaw 15 and engaged threadedly in fixed screw-threaded lugs 27 of one side plate 17. The opposing ends of the two screws 26 can engage opposite sides of one vertical bar member 11 of the rigid suspension harness 10, whereby the jaw plates 24 and 25 can be properly leveled.

Rear arm extensions 28 and 29 of the press scissor jaws are pivotally coupled with a pair of transverse pins 30 supported in openings of the respective jaw side plates 16 and 17. A power cylinder 31 forming the actuator means for the press has its rod 32 pivotally coupled with one of the pins 30 between side plates 16. The cylinder body 33 is similarly coupled with the other pivot pin 30 between the two side plates 17 of lower jaw 15.

The power cylinder 31 has conventional control means 34 including push button means 35 on its rear side as well as an attached vertical manipulating handle 36 primarily for guiding the vertical swinging and the up-and-down movement of the scissor press during use.

A pair of upright manipulating handles 37 are provided on opposite sides of the suspension harness 10 and rising from the bar member 12, FIG. 3, so as to be spaced equidistantly from the handle 36. The two handles 37 are primarily for guiding the scissor press laterally or horizontally. Combined use of the handles 36 and 37 by the operator makes manipulation of the press much simpler than in the prior art. Basically, the press is well balanced on its suspension means so that comparatively little physical effort is required to manipulate it.

The previously-mentioned work-engaging upper jaw plate 24 is flat and is pivotally attached to the upper press jaw 14 by a transverse axis pivot pin 38 which is held in openings of the upper jaw side plates 16 and engages through registering openings 39 in upstanding webs 40 of the jaw plate 24. The upper jaw defined by the plates 16 has an inclined face 41, FIG. 1, for abutment with the pivoted jaw plate 24 when the upper jaw 14 is in close relationship with the lower jaw as shown in phantom lines in FIG. 1. To finely regulate the angle of the upper jaw plate 24 relative to the surface 41 and to the work piece being engaged,a pair of jaw plate adjusting or stop screws 42 are held in nuts 43 fixed to the leading ends of the upper jaw plates 16. The screws 42 are adjustable so that their lower ends can regulate or limit the upward swing of the jaw plate 24 on the pivot pin 38 relative to the inclined surface 41.

The coacting work-engaging lower jaw plate 25 is adjustable in a different manner on the lower jaw plates 17. A pair of slotted brackets 44 fixed to the bottom of jaw plate 25 receives bolts 45 having clamping nuts 46 thereon. Between the nuts 46 and brackets 44, eccentric preferably hexagonal adjusting plates 47 are provided. These elements 47 can be rotated on their eccentric axes receiving the bolts 45 after the nuts 46 are loosened, and such rotation positions another hexagon flat in contact with the top web of each bracket 44 to slightly elevate or lower one or both ends of the jaw plate 25 as shown, for example, in FIG. 6 to achieve its accurate or fine adjustment in the press. It can be noted that the press is adjustable in all important aspects relative to the work pieces being engaged such as truss lumber components. While constructed with this particular usage in mind, the invention certainly is not restricted in its use to truss manufacturing and can be used for a variety of other purposes.

Typically, conventional multi-pronged nailing plates 48 are placed on the lower jaw plate 25 following adjustment of the press for use in connection with lumber components of a certain size. The operator using the controls 34 extends cylinder rod 32 to rock the upper jaw 14 toward the phantom line position in FIG. 1 and the two jaws 14 and 15 and their respective plates 24 and 25 then coact to force the prongs of the nailing plate 48 into the work so as to bridge a joint between truss lumber components or the like and secure them rigidly in a well-known manner.

To assure that the fastener or plate 48 will not be displaced from the scissor press accidentally during its manipulation, opposite side spring-biased guards or retainers 49 are provided on the lower jaw 15 in the following manner. Retainer screws 50 attached to the lower jaw plate 25 and depending therefrom engage and slidably support the guards 49 which are Z-like in cross section, FIG. 4. Biasing springs 51 urge the guards 49 upwardly at all times so that their vertical webs will extend above the top surface of plate 25 to block displacement of the fastener 48. When the press jaws are closed on the work by extension of power cylinder 31, the work or lumber engaging tops of the guards 49 will simply depress them to the broken line positions shown in FIG. 4 so that the guards cannot interfere with the operation of the press.

Another feature of the invention resides in the relationship of the jaw pivot 22 to the jaw plate pivot 38 and power cylinder pivots 30. Preferably, the distance between pivots 22 and 38 is approximately two-thirds of the distance between pivot 22 and either of the pivots 30. This geometry provides an effective mechanical advantage for the two jaws and imparts to the leading ends of the jaws forwardly of their pivot 22 an increased ability to reach into tight quarters as well as a deeper reach forwardly in comparison to the customary rigid C-frame power presses.

The described arrangement of the inclined leading upper jaw surface 41 and screw stop 42 for the rockable upper jaw plate 24 is an important feature of the invention which makes it possible in tight quarters to use only the front half of the upper jaw plate 24 in the area between pivot pin 38 and screws 42.

The advantages of the invention have now been set forth and should be readily apparent to those skilled in the art.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A press for installing nailing plates to truss lumber joints and the like comprising a pair of opposing jaws which are pivotally interconnected between their ends for relative swinging movement toward and away from each other, a suspension harness carrying said jaws and adapted for connection with an overhead movable support, a power actuator for the jaws interconnecting rear extensions thereof on one side of the pivot axis of the jaws, an upper jaw plate rockably mounted on the uppermost of the jaws forwardly of the jaw pivot axis and with the rocker axis of the upper jaw plate parallel to said jaw pivot axis, adjustable stop means for the upper jaw plate on said uppermost jaw and limiting rocking movement of the upper jaw plate in one direction, a lower jaw plate on the lowermost jaw in opposing relationship to the upper jaw plate, and means to finely adjust the level and the angle of the lower jaw plate relative to the upper jaw plate.

2. A press as defined in claim 1, and upwardly yieldingly biased guard elements on at least two opposite sides of the lower jaw plate to prevent displacement of a nailing plate therefrom.

3. A press as defined in claim 1, and said jaws rockably attached on said suspension harness near the center of gravity of the press, and adjustable means on one jaw engageable with the opposite sides of said harness to level the lower jaw plate in relation to said harness.

4. A press as defined in claim 1, and said adjustable means comprising a pair of screw stops on the lowermost jaw in opposing relationship to opposite sides of said harness.

5. A press as defined in claim 4, and said harness comprising an upright substantially rigid frame including spaced upright bar members on opposite sides of said jaws, a top suspension eye, and a bottom cross bar engaged in transverse axis rocker bearing means of the lowermost jaw.

6. A press as defined in claim 1, and said power actuator comprising a single power cylinder unit having an attached controller including a handle.

7. A press as defined in claim 6, and at least one additional handle on one side of said suspension harness.

8. A press as defined in claim 1, and each jaw comprising a pair of parallel side plates of like profile, and spacing and connecting means for the side plates extending therebetween to maintain them in rigid assembled relationship.

9. A press as defined in claim 1, and the uppermost jaw having an inclined surface forwardly of the rocker axis of the upper jaw plate, and said adjustable stop means for the upper jaw plate comprising at least one stop screw on the uppermost jaw above the upper jaw plate at right angles to said inclined surface.

10. A press as defined in claim 1, and said means to finely adjust the level of and the angle of the lower jaw plate comprising slotted brackets dependingly secured to the lower jaw plate, clamping bolt means on the lowermost jaw engaging the slotted brackets, and eccentric axis polygonal rotary adjusters on the clamping bolt means and having multiple flats engageable with lower faces of said brackets.

* * * * *